US006439899B1

(12) United States Patent
Muzslay et al.

(10) Patent No.: US 6,439,899 B1
(45) Date of Patent: Aug. 27, 2002

(54) CONNECTOR FOR HIGH PRESSURE ENVIRONMENT

(75) Inventors: Steven Zoltan Muzslay, Huntington Beach; Carl Rodney Bunke, Riverside, both of CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/020,383

(22) Filed: Dec. 12, 2001

(51) Int. Cl.[7] ..... H01R 13/648

(52) U.S. Cl. ..... 439/98; 439/108; 439/277; 439/283

(58) Field of Search ..... 439/98, 92, 95, 439/96, 97, 101, 108, 271–277, 278–283, 587, 588, 589, 604, 606, 936

(56) References Cited

U.S. PATENT DOCUMENTS

| | | | | | |
|---|---|---|---|---|---|
| 2,906,986 | A | | 9/1959 | Schaefer | 339/60 |
| 2,958,842 | A | | 11/1960 | Schaefer | 339/61 |
| 3,643,208 | A | * | 2/1972 | Massa, Jr. | 439/606 |
| 3,816,641 | A | * | 6/1974 | Iversen | 174/76 |
| 3,945,708 | A | | 3/1976 | Griffin | 339/189 |
| 4,043,630 | A | | 8/1977 | Suverison et al. | 339/218 |
| 4,679,875 | A | | 7/1987 | Ramsey | 439/604 |
| 4,795,360 | A | * | 1/1989 | Newman et al. | 439/278 |
| 5,112,252 | A | * | 5/1992 | Harris | 439/610 |
| 5,120,268 | A | | 6/1992 | Gerrans | 439/736 |
| 5,151,033 | A | * | 9/1992 | Kawai et al. | 439/95 |
| 5,174,769 | A | * | 12/1992 | Dearman | 439/98 |
| 5,371,819 | A | * | 12/1994 | Szegda | 385/75 |
| 5,490,789 | A | * | 2/1996 | Simons | 439/101 |
| 5,542,856 | A | * | 8/1996 | Wood | 439/281 |
| 5,641,307 | A | | 6/1997 | Gerrans | 439/606 |
| 5,681,172 | A | | 10/1997 | Moldenhauer | 439/95 |
| 5,785,544 | A | * | 7/1998 | Linden et al. | 439/278 |
| 5,885,108 | A | | 3/1999 | Gerrans, Jr. | 439/606 |
| 5,890,929 | A | * | 4/1999 | Mills et al. | 439/610 |
| 6,164,997 | A | * | 12/2000 | Davies | 439/320 |
| 6,254,402 | B1 | * | 7/2001 | Barnes, Jr. et al. | 439/95 |

* cited by examiner

*Primary Examiner*—P. Austin Bradley
*Assistant Examiner*—Ross Gushi
(74) *Attorney, Agent, or Firm*—Roger C. Turner

(57) ABSTRACT

A connector is provided for connecting to a device in a high pressure environment, wherein a front portion of the connector body is inserted into a passage of the device so contacts mate, and a nut is screwed into the threaded rear end of the passage until the nut front end presses against a shoulder on the body to press an elastomeric portion of the body against a ledge of the device to seal thereagainst. A grounded wire has its front end crimped to a grounding terminal. A finger on the grounding terminal extends radially through a portion of the body to the outside of the body, the finger being bent and engaging a smooth inner surface on the nut. One connector is formed of an elastomeric front member and a hard plastic rear member that is overmolded to the front member and to a quantity of potting material, the attachment portion of the grounding terminal being molded in the hard plastic rear member. In another connector, only a single hard plastic molded member is used, with the grounding terminal held in the potting material and an elastomeric washer being used for sealing to the ledge.

12 Claims, 3 Drawing Sheets

CONNECTOR FOR HIGH PRESSURE ENVIRONMENT

BACKGROUND OF THE INVENTION

A large number of high pressure connectors are in use to carry electrical power to a water pump that lies at the bottom of a deep (e.g. up to 700 feet) water well. There are other also applications, as well, where an electrical connector must be inserted into a passage of a high pressure connector, that is, a connector that can withstand a high pressure environment such as 2,000 psi. The main wires of the connector are terminated to socket contacts of the connector. In a common prior art type of high pressure connector, a ground wire is soldered or welded to the inside of a stainless steel sleeve which is connected to a grounded housing of the high pressure device. The need to provide a deep drawn stainless steel sleeve for reliability, and to solder or weld the ground wire to the sleeve, results in a considerable cost of the connector. A high pressure connector that could be constructed in a simple design and at lower cost would be of value, especially because a large number of them are sold each year.

SUMMARY OF THE INVENTION

In accordance with one embodiment of the present invention, a connector is provided for use in a high fluid pressure environment for connecting to a device such as a pump motor in the environment, and which can be constructed at low cost. The connector includes a connector body with a frontmost part, a middle part, and a rear part. A nut with an external thread, screws into a threaded hole in a metal casing of the device and presses the body middle part towards a ledge on the device to form a seal thereat. A grounding wire is terminated to a grounding terminal lying in the body rear part and having a finger that projects radially out through the body and that has a finger outer part that is bent to extend forwardly. When the nut is screwed into the device, a smooth inner surface of the nut depresses the finger outer part to establish an electrical connection between the grounding wire and the metal casing of the device.

In one connector, the frontmost mating part and an elastomeric seal that seals against the ledge, are formed as a single elastomeric part. Main wires extend through the elastomeric part and are encapsulated in potting material of a rearwardly-extending sleeve of the elastomeric part. Rigid plastic is then overmolded around the sleeve part and around the grounding terminal except for the projecting finger part.

In another embodiment of the invention, the front mating part, middle part and a rear shell part are all molded as a single piece of rigid plastic. A separate elastomeric ring forms a seal against the ledge. After the wires are inserted through the rear shell part, the rear shell part is filled with potting material.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
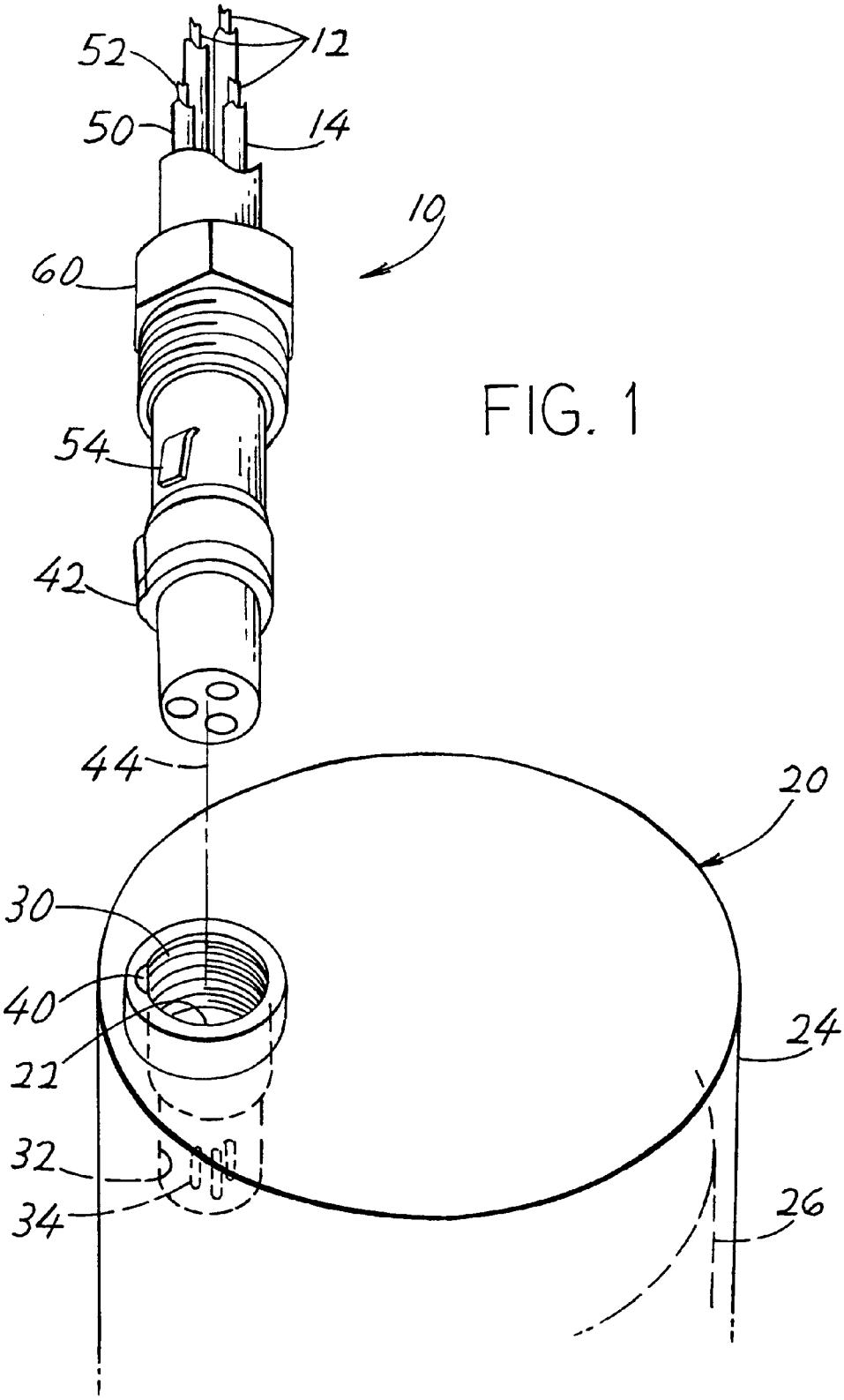
FIG. 1 is an exploded isometric view of a combination of high pressure device and high pressure connector of the present invention.

FIG. 1 illustrates a high pressure connector 10 of the invention which connects conductors 12 of insulated wires 14 to corresponding conductors of an electrically powered high pressure device 20. A very common high pressure device 20 is a motor and pump set that lies at the bottom of a water well that may be up to 700 feet deep for pumping out water from the well. The pressure of water may be very high, and the connector 10 and the walls of a device passage 22 are designed to enable connections to remain sealed despite a high pressure such as up to 2,000 psi. The device 20 includes a metal casing 24 and an inner part 26 to be supplied with electrical power. The device passage includes an outermost largely threaded part 30 and a smaller diameter inner part 32. Two or three pin contacts 34 lie in the inner passage part, depending on the type of power that is supplied. It is noted that the device passage 22 has a polarizing recess 40 that receives a protuberance 42 on the connector to assure that the connector is inserted in the proper rotational orientation about an axis 44. In addition to the two or three power-carrying contacts 12, a grounding wire 50 is provided with a grounding conductor 52. In the present invention, the grounding conductor 52 is connected to a ground terminal with a finger outer part 54 that engages an externally threaded nut 60 to provide a ground connection to the metal threaded outer portion 30 of the device recess.

Figure 2:
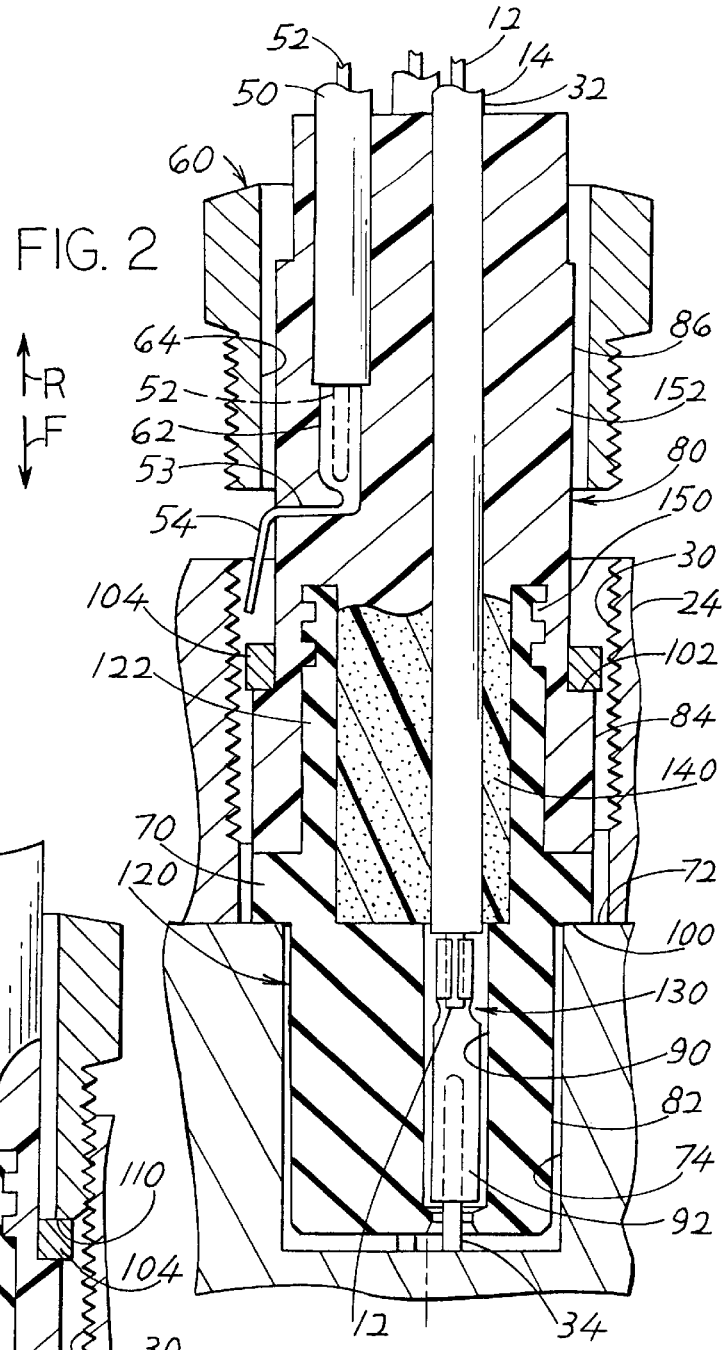
FIG. 2 is a sectional view of the high pressure connector of FIG. 1 lying in the high pressure device but with the nut not yet screwed into place.
Figure 3:
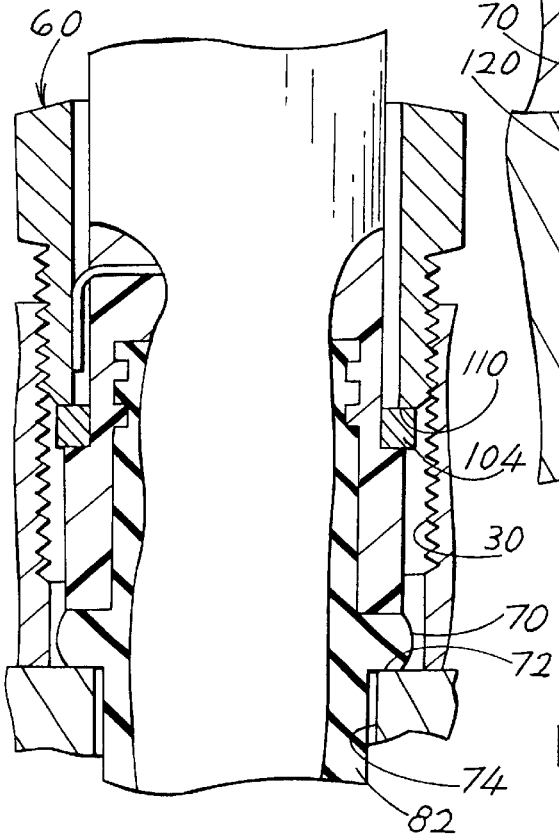
FIG. 3 is a view of a portion of the connector and device of FIG. 2, but with the nut fully screwed into place.

FIG. 2 shows the finger outer part 54 is part of a grounding terminal 62 which is connected to the front F end of the ground connector 52. The nut 60 has a smooth nut inner surface 64 that engages the finger outer part 54 when the nut is pushed forwardly and then screwed into the threaded portion 30 of the device metal casing 24. The finger outer part 54 is preferably resilient, and remains in firm contact with the nut inner surface when the nut is fully screwed into place. The finger has a circumferential (around axis 44) width that is a plurality of times its radial thickness to avoid circumferential deflection by the nut inner surface. FIG. 3 shows the nut 60 fully screwed into place and causing an elastomeric seal portion 70 to seal against a ledge 72 that extends between the larger diameter passage portion 30 in the metal casing, and a smaller diameter inner passage portion 74 of the device passage.

FIG. 2 shows that the connector includes a body 80 with a frontmost mating body part 82, a middle body part 84 lying rearward R of the mating part, and a rear body part 86 that extends rearward of the middle body part. The mating body part 82 fits in the device passage front end 74 and has a plurality of contact-holding bores 90 that holds socket contacts 92. The socket contacts receive the pin contacts 34 of the device. The middle body part 84 lies in the device passage outer, or rear portion 30, which is of larger diameter than the front portion 74. The rear body part 86 projects rearwardly out of the device passage. The middle body part forms an annular forwardly-facing shoulder 100. In the embodiment of FIG. 2, the shoulder 100 directly engages the ledge 72. The middle body part also forms an annular rearwardly-facing shoulder 102, with a metal washer 104 lying on the shoulder 102.

When the nut 60 is screwed tightly into place, as shown in FIG. 3, a nut front end 110 presses forwardly against the metal washer 104, thereby compressing the elastomeric part 70 which presses against the ledge 72 to form a seal at the ledge.

FIG. 2 shows that the forward mating body part 82 and the elastomeric seal 70 are molded integrally as a single member 120 of elastomeric material. The member 120 also includes a sleeve portion 122 that extends rearwardly of the elastomeric seal 70 and of the forward matting body part 82. To construct the connector of FIG. 2, applicant first forms the body 120 by molding, and then installs main wire-end-contact assemblies 130 in place as shown. Each assembly 130 includes a main wire 14 whose conductor at 12 is fixed to the rear end of a socket contact 92, as by crimping and/or soldering. The socket contact and a front end of the wire 14, including the wire insulation 132, projects into the contact-holding bore 90 in the forward mating body part. After all two or three main contact assemblies 130 are installed, a quantity 140 of potting material is poured into the sleeve portion 122 to largely fill it. The potting material 140 is a material such as epoxy in a fluid state that cures or otherwise hardens, and serves to form a seal that prevents moisture from entering the contact-holding bore 90 by flowing forwardly around a main wire 14.

After the contact assemblies 130 are installed, the ground wire 50 with the ground terminal 62 fixed to the ground wire conductor 52, are placed in a mold, in the position shown. Then, a rigid engineering plastic is injected into the mold to fill it to the configuration shown in FIG. 2. The sleeve portion 122 of the elastomeric molded part 120 has grooves 150 that lock it to the rigid engineering plastic that is molded around it and the rear end of the quantity 140 of potting material. The rigid engineering plastic has a rear plastic part 152 that is solid, in that the rigid plastic extends across the entire diameter of the body except for the wires 14 and the ground wires and grounding terminal.

Applicant is able to use an epoxy potting material 140 that cures in about one-half hour (in an oven) instead of requiring a special epoxy that can withstand a high pressure such a 2,000 psi and which requires more time to cure.

An elastomeric material may be defined as one with a Young's modulus of elasticity of no more than about 50,000 psi. A rigid engineering plastic may be defined as one having a Young's modules of elasticity greater than 100,000 psi, and preferably more than 200,000 psi.

Figure 4:
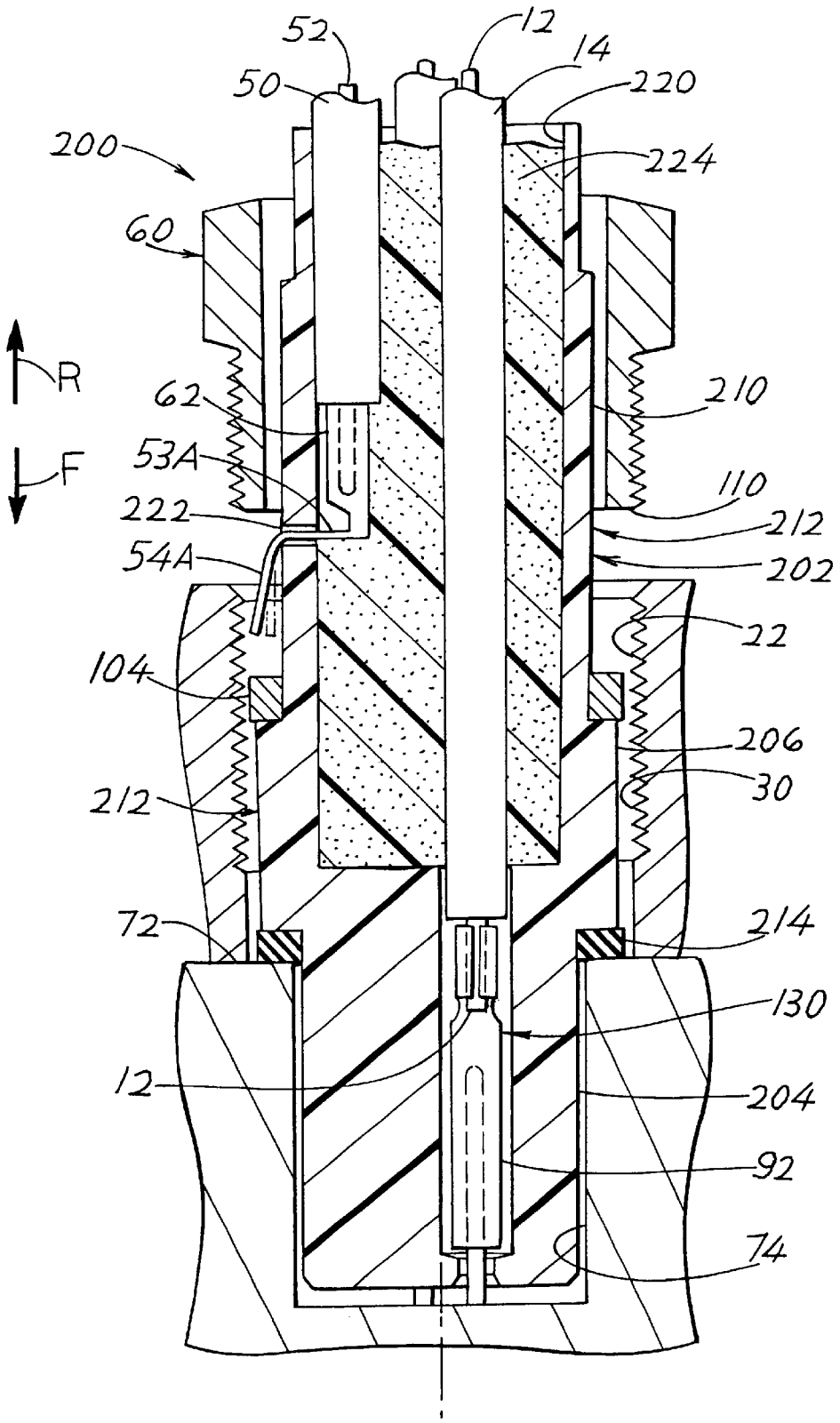
FIG. 4 is sectional view of a high pressure connector of another embodiment of the invention, and of a portion of the high pressure device of FIG. 1, with the connector installed in the device but the nut not yet screwed into place.

FIG. 4 illustrates an electrical connector 200 of another embodiment of the invention. The connector 200 includes the main wire-and-contact assemblies 130 that each includes a socket contact 92 attached to a conductor 12 of a main wire 14. The connector 200 also includes a ground terminal 62 that is attached to a conductor 52 of a ground wire 50 and that has a finger 53A with a finger outer part 54A. The connector also includes a nut 60 whose nut front end 110 can engage a metal washer 104.

The connector 200 includes a connector body 202 with a frontmost mating body part 204 that fits in the device passage inner part 74, a middle body part 206 lying in the device passage outer part 30, and a rear body part 210 that extends reward of the middle body part and that projects out of the device passage 22. The three body parts 204, 206 and 210 are integrally formed as a separate member 212 of rigid engineering plastic. An elastomeric seal part 214 that forms a seal against ledge 72, is a separate elastomeric washer.

The combination of ground wire 50 with the ground terminal 62 attached, is lowered into the rearwardly-opening interior 220 of the shell-shaped rear body part 210. The finger 53A is inserted through a hole 222 in the rear body part or shell part 210. The hole 222 can be formed during molding of the shell part 210 with the rest of the member 212, or can be formed as by drilling, after molding. The finger 53A of the ground terminal can slide radially outward through the hole 222. With the main wire-and-contact assemblies 130 installed and the ground wire 50 with ground terminal 62 placed in the shell part 210, the shell part is filled with a potting material 224 such as an epoxy, and the epoxy is cured. An epoxy that can withstand high pressure such as 2,000 psi is used, and it may require more than an hour to cure.

After the epoxy has cured, the projecting finger portion 54A is bent radially inwardly, as to the position shown in solid lines in FIG. 4. The projecting finger portion will be deflected further radially inwardly by the nut 60.

Applicant prefers the construction of FIG. 4, in that it results in a lower cost connector. That is, only a single member 210 must be injection molded. Although it takes longer for the potting material 224 to cure, the use of a single molded member results in an overall lower cost.

Thus, the invention provides a high pressure connector which can be constructed at moderate cost. The connector includes a connector body with a front mating part that fits in a small diameter device passage inner portion, a middle body part that fits in a larger device outer passage portion, and a rear body part that projects rearwardly out of the device passage. The middle body part forms a forwardly-facing shoulder that can be pushed forward by a threaded nut to compress an elastomeric seal against a ledge of the device. A ground wire is connected to a metal casing of the device through a ground terminal that has a finger projecting outside the rear body part and bent to extend largely forwardly. As the nut is moved forwardly and screwed into the metal casing of the device, it engages the bent projecting finger portion, to establish electrical connection of the ground wire to the casing through the finger and nut. One connector forms the body of a first molded elastomeric part that forms the front body part and the elastomeric seal at the front of the middle body part. That embodiment of the invention also includes an overmolded rigid engineering plastic that is overmolded around a rear of the molded elastomeric part and against potting material in the molded elastomeric part. In another embodiment of the invention, the body is formed of a single molded rigid plastic member, with an elastomeric seal placed at the rear end of the front body part to seal against the ledge of the device. In that case, the rear body part is in the form of a shell that is filled with potting material.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A high pressure connector for connecting to device contacts of a high pressure device and sealing to the device, the device having walls forming a connector-receiving passage with a metal threaded outer portion, the connector including a connector body having an axis and having a body front mating part with a plurality of connector contacts therein, a body middle part that lies in said passage outer portion and a body rear part that extends rearward of said body middle part, including a plurality of wire-and-contact assemblies that extend forwardly through said body and include connector contacts lying in said body front mating part and including a ground wire with a ground conductor, said body includes an elastomeric seal part that presses against said device, and said connector includes an electrically conductive nut that threadably engages said threaded outer portion and presses said seal part against said device, wherein:

said connector includes a ground terminal that connects to said ground wire at a location within said body rear part, said ground terminal having a finger that projects largely radially through said body rear part and that has a finger outer part that lies outside said body rear part;

said nut having an inner surface that moves around said finger outer part and makes contact with said finger outer part as well as with said casing.

2. The connector described in claim 1 wherein:

said body includes an integral molded elastomeric member that includes said body front mating part and said elastomeric seal part and an internal sleeve portion that forms part of said body rear part, said body rear part also including a shell member of rigid polymer material with a front portion that surrounds said internal sleeve portion, said shell member having a shell member rear portion;

said internal sleeve portion of said elastomeric member has an open rear end; and including a quantity of potting material that lies in said internal sleeve portion and that forms a seal around said main wires;

said shell member is overmolded around said internal sleeve portion and against a rear end of said potting material and said shell member rear portion is solid and extends rearward of said internal sleeve portion.

3. The connector described in claim 1 wherein:

said body front mating part and said body rear part, are integrally molded of rigid engineering polymer and form a forwardly-facing shoulder;

said elastomeric seal part of said body, includes a ring of elastomeric material that lies against said forwardly-facing shoulder.

4. The connector described in claim 1 wherein:

said body rear part includes a sleeve-shaped shell wall centered on said axis, said shell wall having a through hole therein extending largely perpendicular to said axis and of larger width than said ground terminal finger to easily project said finger therethrough;

said connector body includes a quantity of potting material which fills said sleeve-shaped shell wall to a location rearward of said through hole and that encapsulates a part of said ground terminal that lies within said shell wall but not a part of said finger that lies outside said shell wall.

5. A high pressure connector for mating with a high pressure device that has a rearwardly-opening device passage with a small diameter device front passage end, an internally threaded larger diameter device rear passage end, and a rearwardly-facing ledge lying between said passage ends, comprising:

a connector body that includes a mating body front part that fits in said device passage front end and that has a plurality of contact-holding bores, a middle body part lying rearward of said mating body part and lying in said device passage rear part, and a rear body part that extend rearward of said middle body part;

said middle body part forming an annular forwardly-facing shoulder lying in line with said ledge and forming an annular rearwardly-facing shoulder lying rearward of said forwardly-facing shoulder;

said body including an elastomeric portion that directly engages said ledge;

a nut that lies around said body rear part, said nut having an external thread for threadably engaging said device passage threaded rear end;

a metal washer that lies against said rearwardly-facing shoulder of said body middle part, said nut having a front end for pressing forwardly against said metal washer as said nut is threaded into said device passage threaded rear end;

a plurality of main wire-and-contact assemblies that each extends forwardly through said body rear part and middle part and into said contact-holding bores;

said rear body portion is in the form of a shell with an open rear end;

a quantity of potting material that fills at least said shell and lies around said main wire-and-contact assemblies, except for front parts of said main wire-and-contact assemblies;

said mating body part, middle body part, and shell are all molded integrally of a rigid polymer, and said elastomeric portion of said body is a separate elastomeric member that lies against said middle body part forwardly-facing shoulder.

6. The connector described in claim 5 wherein:

said connector body has an axis and said nut has a largely cylindrical inner surface; and including a ground wire that extends forwardly into said shell;

a ground terminal that has a first part that is terminated to said ground wire and that has a finger that extends through said shell wall and that has a projecting finger part lying outside said shell and is radially inwardly deflectable by said nut to engage said nut inner surface.

7. The connector described in claim 5 wherein:

said rigid polymer has a hole therein through which said finger extends, said hole being sufficiently larger than said projecting finger part so said projecting finger part can be slid through said hole.

8. A high pressure connector for mating with a high pressure device that has a rearwardly-opening device passage with a small diameter device front passage end, an internally threaded larger diameter device rear passage end, and a rearwardly-facing ledge lying between said passage ends, comprising:

a connector body that includes a mating body front part that fits in said device passage front end, said body front part having a plurality of contact-holding bores, a body middle part lying rearward of said body front part and lying in said device passage rear end, and a body rear part that extends rearward of said body middle part;

said body middle part forming an annular forwardly-facing shoulder lying in line with said ledge and forming an annular rearwardly-facing shoulder lying rearward of said forwardly-facing shoulder;

said body including an elastomeric portion that directly engages said ledge;

a nut that lies around said body rear part, said nut having an external threaded part for threadably engaging said device passage threaded rear end;

a metal washer that lies against said rearwardly-facing shoulder of said body middle part, said nut having a front part for pressing forwardly against said metal washer as said nut is threaded into said device passage threaded rear end part;

a plurality of main wire-and-contact assemblies that each extends forwardly through said body rear part and middle part and into said contact-holding bores;

said elastomeric portion is part of said body middle part, and said body front part and at least a front portion of said middle body middle part including said elastomeric portion are integrally molded of elastomeric material to form a front elastomeric member, said front elastomeric member also including an internal sleeve part with a rearwardly-open rear end that lies rearward of said body front part;

a quantity of potting material that lies in said internal sleeve part and that surrounds and seals to said main wire-and-contact assemblies;

said rear body part is molded of rigid polymer material around said internal sleeve part of said front elastomeric member and against a rear end of said potting material, and said rear body part includes an integrally molded rear end that extends rearward of said internal sleeve part and potting material and that surrounds wires of said main wire-and-contact assemblies.

9. The connector described in claim 5 wherein:

said connector body has an axis and said nut has a largely cylindrical inner surface; and including a ground wire that extends forwardly into said shell part;

a ground terminal that has a first part that is terminated to said ground wire and that has a finger that extends through a wall of said shell part and that has a projecting finger part lying outside said shell part and being radially inwardly deflectable by said nut to engage said nut inner surface, at least said first part of said ground terminal being encapsulated in said molded polymer material.

10. A combination of a high pressure connector and a high pressure device that receives and connects to contacts of the connector, wherein the high pressure device has passage walls forming a rearwardly-opening device passage with a small diameter device front passage part, an internally threaded larger diameter device rear passage part, and a rearwardly-facing ledge between said passage parts, wherein:

said connector has a body with an axis and a forwardmost mating body front part that lies in said device passage front part, said connector has a plurality of contacts that lie in said body front part and engage contacts of said high pressure device, said body has a body middle part that lies in said device rear passage part, said body has an elastomeric part that lies against said ledge and said body has a body rear part;

said connector has a nut with external threads that screws into said threaded device rear passage part and that presses said body middle part forwardly, said nut having a smooth internal surface;

said connector has an electrically grounded finger that lies on the outside of said rear body part, said nut internal surface engaging said finger and sliding around said finger as said nut is turned.

11. The combination described in claim 10 wherein:

said finger has a radial thickness and has a circumferential width that is a plurality of times greater than said thickness.

12. A method for connecting a high pressure connector to a high pressure device that has passage walls forming a front passage part, an internally threaded larger diameter device rear passage part that opens rearwardly, and a rearwardly-facing ledge between said passage parts, comprising:

pushing a connector body partially into said device passage parts, including inserting a front mating part of the body into said device front passage part while mating device contacts engage contacts of said connector, until an elastomeric portion of said body rest on said ledge and a middle part of said body which has a rearwardly-facing body shoulder lies in said device rear passage part;

moving a nut forward around said body and against a rear end of said passage walls and turning said nut to thread it into said internally threaded device rear passage part while pressing forwardly against a metal washer that lies on said rearwardly-facing body shoulder to compress said elastomeric portion against said ledge;

establishing an electrically grounded finger in extension largely forwardly from an outside of said body at a location rearward of said rearwardly-facing body shoulder;

said step of moving a nut forwardly and turning said nut includes sliding an internal surface of said nut across said finger.

* * * * *